United States Patent [19]

Brand et al.

[11] 4,181,316

[45] Jan. 1, 1980

[54] SKATE BOARD

[75] Inventors: Dieter Brand, Haar; Fritz G. Pape, Eisbergen, both of Fed. Rep. of Germany

[73] Assignee: Stiebel Eltron GmbH & Co. KG, Holzminden, Fed. Rep. of Germany

[21] Appl. No.: 905,439

[22] Filed: May 12, 1978

[51] Int. Cl.[2] ..... A63C 17/14

[52] U.S. Cl. ..... 280/11.2; 280/87.04 A

[58] Field of Search ..... 280/11.2, 11.2 B, 11.21, 280/87.04 A, 87.04 R; 188/29, 2 R

[56] References Cited

U.S. PATENT DOCUMENTS

| | | | |
|---|---|---|---|
| 341,999 | 5/1886 | Davis | 280/11.2 |
| 4,003,582 | 1/1977 | Maurer | 280/11.2 |
| 4,055,234 | 10/1977 | Burton | 280/11.2 X |
| 4,084,831 | 4/1978 | Akontch et al. | 280/11.2 X |
| 4,088,334 | 5/1978 | Johnson | 280/11.2 |
| 4,092,033 | 5/1978 | Swain | 280/87.04 A |
| 4,094,524 | 6/1978 | Carroll | 280/11.2 |

*Primary Examiner*—Joseph F. Peters, Jr.
*Assistant Examiner*—Gene A. Church
*Attorney, Agent, or Firm*—Haseltine, Lake & Waters

[57] ABSTRACT

A skate board with two wheel mounts located on one board, in which each of the wheel mounts holds an axle carrier with a roller axis for two rollers in an elastic manner. Steering movements of the roller axes are initiated by shifting the weight of the rider. At least one of the two roller axes is pivotal about a transverse axis running transverse to the longitudinal axis of the board, so that the board can be lowered relative to the roller axis by applying weight. The board can be raised relative to the roller axis, on the other hand, by a spring force upon removal of the weight. The transverse axis is rigidly connected to the board so that lowering and raising the board will not initiate steering movements of the roller axis. The board, furthermore, has a brake which acts on the rollers if the board is raised and carries no load. The brake is released by applying weight and lowering the board. The axle carrier with the roller axis can be pivoted relative to the wheel mount about the transverse axis, and the wheel mount with the axle carrier and roller axis can be pivoted relative to the board about that transverse axis.

7 Claims, 4 Drawing Figures

SKATE BOARD

BACKGROUND OF THE INVENTION

The present invention relates to a skate board with two wheel mounts located on one board where—similar to a roller skate, but with much larger distance between the axes and being steerable—each of these wheel mounts holds an axle carrier with a roller axis for two rollers. The relatively long and relatively narrow board which may be made of wood, light metal or another suitable material, as a rule is oval-shaped and is at least long and wide enough so that the skate board rider can stand on the board with the legs more or less spread apart and, by leaning forward or backward, can shift his center of gravity to the right and left transversely to the direction of travel. The two axle carriers are elastically mounted in the two wheel mounts in such a way that the two roller axes, which may comprise through-going axes (shafts) or stubshafts on the axle carriers, will be at right angles to the longitudinal axis of the board and to the direction of travel if the weight on the board is uniformly distributed. A shifting of the weight distribution of the rider on the board will produce a tilting (pivoting) of the roller axes in relation to the longitudinal axis of the board and hence a steering movement in such a way that the skate board runs in a curve towards that side to which the rider has shifted his body weight.

Like roller skates, such skate boards are used as sports equipment and as toys. The known skate boards have the great disadvantage that their use is not free from hazard, particularly when children use them as toys on public thoroughfares. They constitute a particularly great source of danger when the rider, loosing his balance, jumps from the board or falls from it and the skate board continues to roll on without control. In such cases, a skate board of low weight, depending on its speed, may roll from a sidewalk into the street and cause traffic accidents, run against vehicles parked on the street or against other objects on the sidewalk or at the end of the sidewalk, and damage them. In particular, the skate board may strike the feet and legs of other pedestrians and cause serious injuries or fractures.

For a long time, there have been known scooters with a foot brake where a brake pedal is located at the rear end of the scooter; this brake pedal can be actuated by the child on the scooter with the foot, pressing a brake shoe against the rear wheel of the scooter by means of a linkage. In an identical manner (U.S. Pat. No. 3,288,251), a brake pedal has been placed on the rear end of a skate board; this pedal can be actuated by the rider's leg, pressing brake shoes against the rollers of the rear wheel mount via a linkage. In another, similar design (U.S. Pat. No. 3,945,655), the brake pedal is located on the forward end of the skate board and connected by a cable underneath the board to a linkage on the rear wheel mount; this linkage presses the brake shoe against the rear rollers. These foot brakes can be actuated only by the rider on the skate board and thus do not avoid the great hazards described above when the rider jumps or falls from the board. In order to counteract these hazards, there is also known a foot brake (U.S. Pat. No. 3,385,608), where, in a kinematic reversal of the operation of the above foot brakes, the brake shoes are forced by spring force against the rollers and the brake is disconnected by pressing the pedal. For this purpose, a base support is fastened underneath the skate board on which a two-arm rocker lever is held on an axis (shaft). One arm of the rocker lever on which the brake shoes are mounted is under the action of springs which press the brake shoes against the rollers by tilting the rocker lever. The other arm of the rocker lever mounts a brake linkage which passes from below through the board and has a pedal on the topside of the board projecting from the board surface. When using the skate board, the rider must step with one foot on the pedal and push it down, tilting the rocker lever and lifting the brake shoes, against the spring force, from the rollers so that the brake is released. This kinematic reversal of the operation of the foot brake has the advantage over the above-described foot brakes that the brake acts automatically and brakes the skate board when the pedal is not actuated or not under load, for example, when the rider jumps or falls off. However, the retention of the principle of actuating a brake by a pedal has the following great disadvantages. The pedal projecting from the surface of the skate board constitutes an additional source of injuries. In particular, the pedal forces the rider to assume a specific position on the skate board, namely, he must always have one foot on the pedal. This restricts the rider's freedom of movement if he wants to push off with one foot from the ground on a track without incline or little incline. By limiting the freedom of movement of the rider, balancing on the skate board and generation of steering movements by the above-described weight shifts is made difficult. A particularly great hazard is produced by the brake if the rider loses balance and, to regain his equilibrium, instinctively raises the leg off the pedal; instead of balancing in this way by his arms and one leg to regain equilibrium, by releasing the pedal there occurs a strong breaking effect so that the rider falls forward and may injure himself seriously.

The known brakes show that foot brakes with a brake pedal to be actuated by the rider are not suited to solve the above problems of skate boards.

It is, therefore, an object of the present invention to eliminate the above disadvantages and to provide a skate board suitable as sports equipment and for adolescents and as toys where the above causes for causing bodily injuries and material damage are removed in an optimum manner, achieving maximum safety and hazard-free use.

Another object of the present invention is to provide a skate board of the foregoing character which is substantially simple in construction and may be economically fabricated.

A further object of the present invention is to provide a skate board, as described, which has a substantially long useful life, and may be readily maintained in service.

SUMMARY OF THE INVENTION

The objects of the present invention are achieved by providing that at least one of the two roller axes is pivotable about a transverse axis, running transversely to the longitudinal axis of the board, in such a way that the board is lowered relative to the roller axis when under weight load, and is raised relative to the roller axis by a spring force when the weight is removed; the transverse axis is rigidly connected to the board in such a way that lowering and raising cause no steering movements of the roller axis, and providing on the board a brake which, with a raised, weight-relieved board, acts on the rollers and is released when weight is applied to the board and it is lowered.

The novel features which are considered as characteristic for the invention as set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
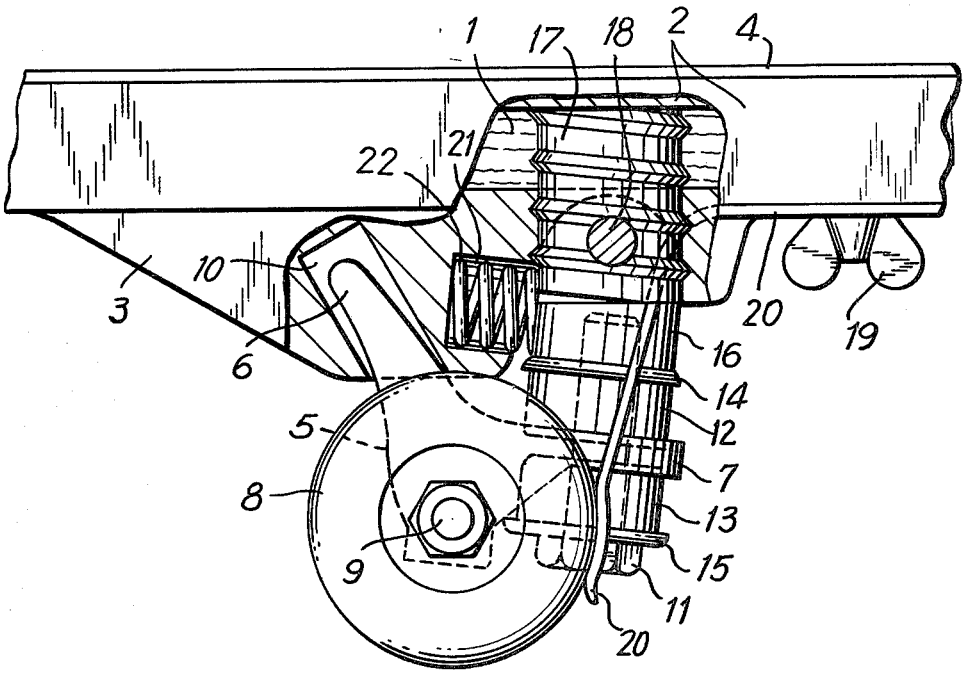
FIG. 1 is a partial sectional sideview of the skate board arrangement, in accordance with the present invention.

The skate board in FIG. 1 has a board 1 provided in accordance with the present invention with a rubber-like elastic casing 2 on whose underside a wheel mount 3 is located. The casing 2 may be rubber or foam rubber, preferably polyurethane integral foam, and may on the sides around the board 1 have a thicker wall thickness, preferably thick foam beads. In this manner, as in the use of such foam cushions in automobiles, the impact of parts of the body striking them is damped (reduced) and the hazard of injuries on hard and sharp edges is avoided. Thus, if people or objects are struck by the skate board, bodily injuries or material damages are avoided or at least made less severe. The casing 2 on its topside has a corrugated surface 4 which gives the rider a safe, slip-free hold on the skate board.

An axle carrier 5 mounts two rollers (wheels) 8 with their roller axis 9 which extends in the unloaded state at right angles to the longitudinal axis of the board 1. The axle carrier 5 has two arms 6 and 7 arranged behind each other in the direction of the longitudinal axis of board 1 and are located between the two rollers 8. Arm 6 is axially displaceable in a hole 10 of the wheel mount 3 which is part of the casing 2 and is of rubber-like elastic material, so that arm and hold jointly form a pivot bearing 6, 10. The other arm 7 is connected to a screw bolt 11 which extends with radial play through a hole in the arm, between block-shaped rubber shock absorbers 12, 13 which are clamped by means of screw bolt 11 between metal washers 14, 15 and are mounted on a base support 16 which is connected, in the manner described below, to the wheel mount 3 or the board 1, respectively. This mounting of arms 6, 7 of the axle carrier 5 achieves a steerability of the skate board because steering movement of roller axes 9 can be effected in the following manner. If the rider standing on board 1 shifts his weight transversely to the longitudinal axis of board 1 to one side, the roller 8 on this side is under a greater load than the other roller, so that the rubber shock absorbers 12, 13 are compressed more on this side than on the other, the rubber of the more heavily loaded side shifting to the less loaded side. Arm 7 located between rubber shock absorbers 12, 13 is moved along by the rubber, that is, it is moved transversely to the longitudinal axis of board 1. However, since the other arm 6 does not participate in the transverse shift and can only pivot in hole 10, this pivot bearing 6, 10 forms a fulcrum about which the axle carrier 5 with the roller axis 9 rotates so that the roller axis 9 which moves from the right-angle position for straightforward travel, pivots into an oblique position for curved travel. In this manner, a desired larger or smaller radius of curvature can be achieved by a smaller or larger weight shift. By more or less tightening the screw bolt 11, the rubber shock absorbers 12, 13 receive a smaller or larger pre-loading (pre-tension) so that they can be deformed more or less easily by shifting the rider's weight; in this way, the steering response of the skate board can be changed or adapted to the weight of the rider.

A bushing 17 is screwed into the board 1. This bushing holds a transverse axis 18 on which the base support 16 is pivotally mounted so that, in accordance with the present invention, the axle carrier 5 with the roller axis 9 can be tilted about the transverse axis 18 with respect to the wheel mount 3; the arm 6 of axle carrier 5 can move axially in the hole 10 of the wheel mount 3. Due to this arrangment and the rigid connection of transverse axis 18 to the board 1, no steering movement of roller axis 9 are initiated during pivotal movements of axle carrier 5 about the transverse axis; rather, the steering movements are effected independely of the above-mentioned pivotal movements simultaneously or not simultaneously exclusively by the above-described weight shift.

Wing nuts 19 fasten brakes 20 to broad 1. With the skate board not under load, these brakes contact rollers 8 and comprise wire-like or strip-iron curved pieces, leaf springs, etc.; they can be made of spring steel or other suitable material and, to increase the braking friction, may have a brake coating of suitable material. A hole 21 in the wheel mount 3 contains a spring 22 which presses against the base support 16 and thus presses the rollers 8 against the brakes 20; the pivotal movement of base support 16 about the transverse axis caused by the spring 22 is restricted by brakes 20. When board 1 is loaded, the base support 16 and the axle carrier 5 with the roller axis 9 are pivoted against the pressure of spring 22 about the transverse axis 18; arm 6 moves axially in hole 10 and the rollers 8 will detach from brakes 20 and will be raised.

In this manner, the roller axis 9 can pivot about the transverse axis running transversely to the longitudinal axis of the board 1 in such a way that when the rider steps on the skate board, the board 1 is lowered by the load of the weight against the spring force 22 with respect to roller axis 9; if the weight is removed, the board 1 is raised by the spring force with respect to the roller axis 9; with raised, unloaded board 1, brakes 20 act on the rollers 8 and by loading and lowering the board 1, the brakes 20 are detached and the rollers 8 are released. As already described above, the arrangement of transverse axis 18 in accordance with the present invention prevents the lowering or raising of board 1 from initiating steering movements of the roller axis 9. If the rider jumps or falls from the skate board, brakes 20 immediately are actuated so that the skate board does not continue to travel with undiminished speed or even increasing acceleration, but is brought quickly to a stop over a very short distance, so that collisions are avoided, or collisions with person or objects in the immediate vicinity are damped in such a way and proceed at such a low speed, that injuries and material damages are eliminated as much as possible.

The embodiment of FIG. 1, by making wheel mount 3 part of casing 2, makes possible an extremely simple and cheap manufacture of the wheel mount and reduces assembly effort, by simplifying the production of the skate board by savings in material and labor cost. At the same time, however, the embodiments of FIGS. 2 and 3 have the advantage that the invention can be used on other skate boards with a board without a casing and can be installed in already existing skate boards of the known type by replacing the wheel mount.

Figure 2:
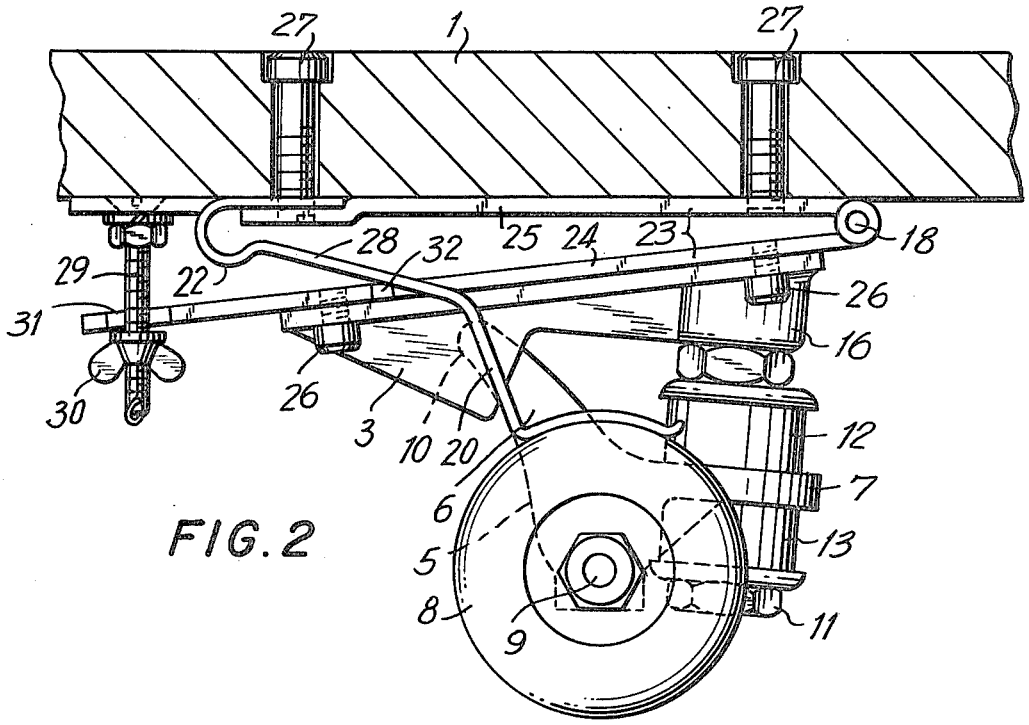
FIG. 2 is a partial sectional sideview of another embodiment of the arrangement of FIG. 1.
Figure 3:
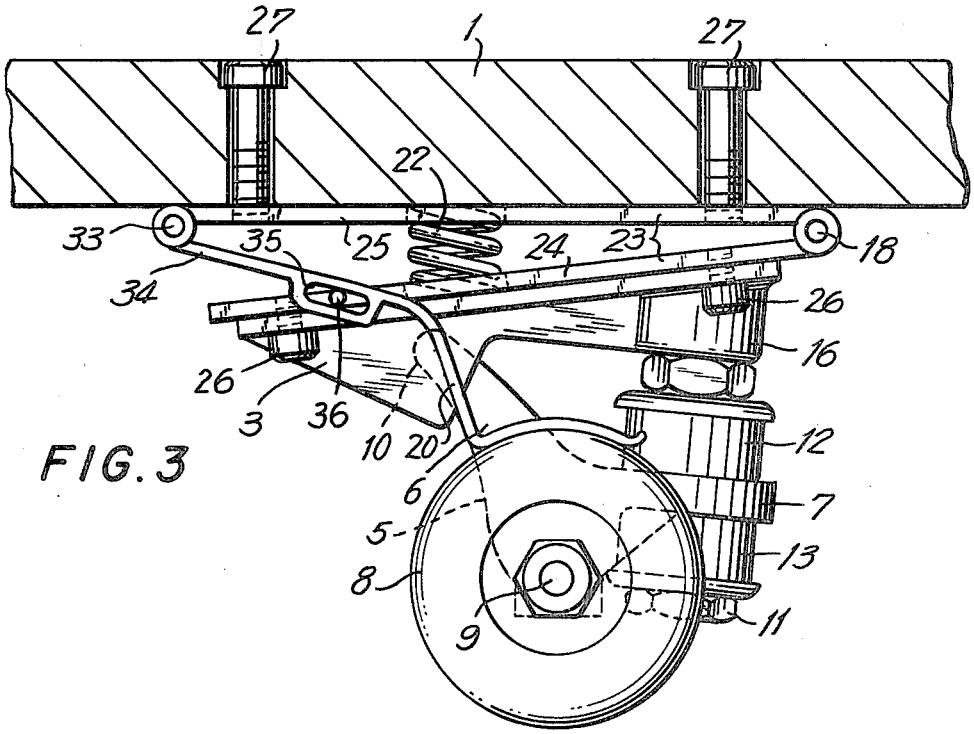
FIG. 3 is a partial sectional sideview of a still further embodiment of the arrangement of FIG. 1.
Figure 4:
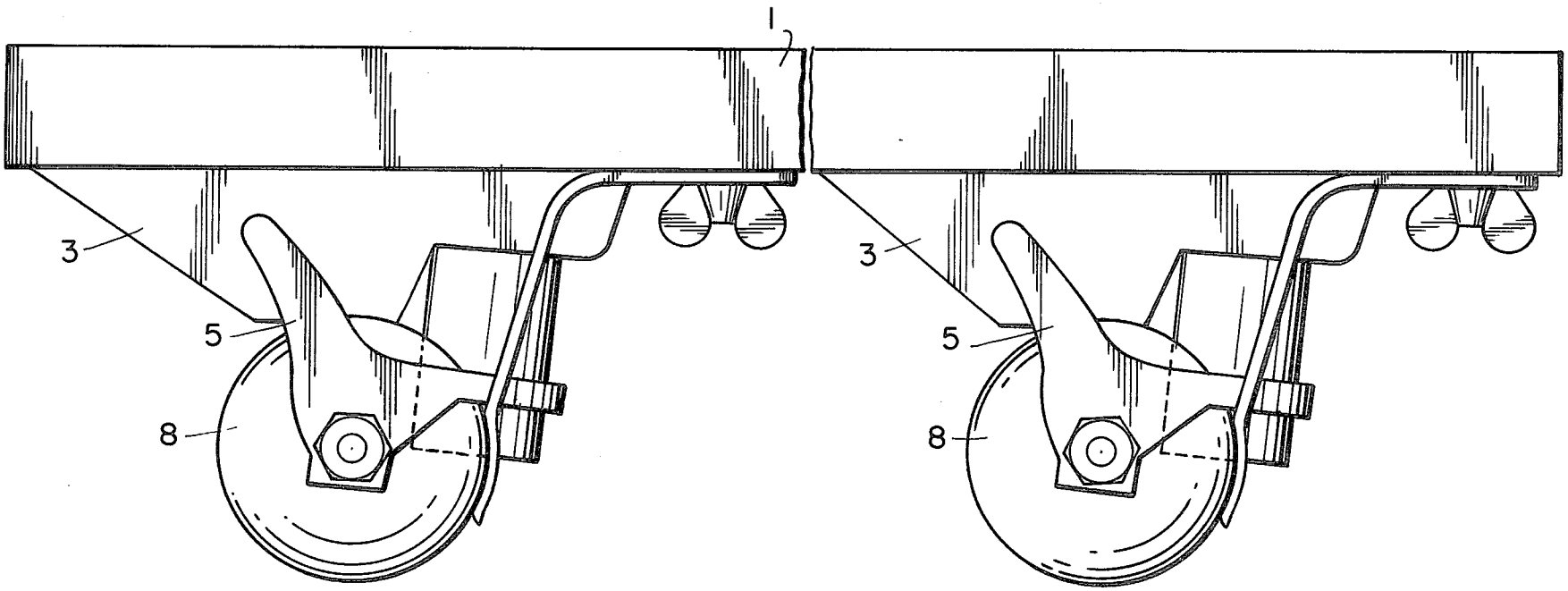
FIG. 4 shows a schematic view with two wheel mounts and two axle carriers.

The embodiments of FIGS. 2 and 3 show wheel mounts of known design, made, for example, from die castings, and differing in principle from the embodiment of FIG. 1 only in that the base support 16 is a fixed part of the wheel mount 3. Since the wheel mount 3 is not made of a rubber-like elastic material, but of a hard rigid material, the arm 6 of the axle carrier 5 in the hole 10 of wheel mount 3 is encased with rubber, so that the arm 6 in hole 10 has the required freedom of movement to form the above-described pivot bearing 6, 10. Otherwise, design, mounting and operation of axle carrier 5 with roller axis 9, rollers 8 and rubber shock absorbers 12, 13 are similar to the above-described embodiment of FIG. 1.

To achieve the pivoting ability of the roller in accordance with the invention, the wheel mount 3 of the embodiments in FIGS. 2 and 3 is mounted on one leg 24 of a hinged wheel mount carrier 23 and fastened with screws 26. The other leg 25 of the wheel mount carrier 23 is fastened by bolts 27 to board 1. The hinge pin joining the two legs 24, 25 is formed by transverse axis 18. In this manner the wheel mount 3 with the axle carrier 5 and the roller axis 9 can be pivoted about the transverse axis 18 relative to board 1.

In FIG. 2, one of bolts 27 fastens a steel member 28 of spring steel to board 1. This member on its one rounded end forms a spring 22, and its other end forms the brake. By the force of spring 22, the brake 20 is pressed against the roller 8 and the legs 24, 25 of the wheel mount carrier are pushed apart so that the board 1 is raised relative to the roller axis when weight is taken off. During this process, the opening angle between legs 24, 25 is restricted by a screw bolt 29 with wing nut 30; this bolt is fastened to the board 1 and passes through a hole 31 in leg 24. When, through a load on the board 1, the leg 24 with the wheel mount 3 is pivoted about the transverse axis 18, a cam 32, located on leg 24, presses from below against the steel member 28 so that brake 20 is released.

In FIG. 3, a spring 22 is located between the legs 24, 25 of the wheel mount carrier 23. On the end away from the transverse axis 18, the leg 25 has another hinge 33 to which a member 34 is linked. The member 34 may, for example, be a leaf spring or may be a casting or a forging. Member 34 has an oblong hole 35 which holds a trunnion 36 which is part of leg 24. With no load on board 1, the spring 22 forces the legs 24, 25, which are hinged to transverse axis 18, apart; simultaneously, member 34 is moved by trunnion 36 about hinge 33 and the brake 20 is pressed against the roller 8. With the board 1 under load, spring 22 is compressed and trunnion 36 releases the brake 20.

During tournaments or similar events there are figure tracings or exercises where, for example, the skate board must travel underneath an obstacle while the rider must jump over the obstacle, must then land on the skate board behind the obstacle, and continue his ride. So that the brake 20 can be disconnected for such events, the board 1, in another embodiment of the invention, can be locked in the lowered position relative to the roller axis 9 where the brake 20 is released. In the embodiment of FIG. 2 this is done by tightening the wing nut 30 on screw bolt 29. In an identical or similar manner, locking locking of the brake in the released position can be provided for the embodiments of FIGS. 1 and 3.

Wherever in the above description it is indicated that the brake acts on the rollers, it is intended to signify both a direct and an indirect action of the brake on the rollers; this means that the brake, to brake the skate board, may contact the rollers themselves (as in the embodiments in the drawing), or rotating axis, or stub-shafts of the roller, or the riding surface.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, therefore, such adaptations should and are intended to be comprehended within the meaning and range or equivalents of the following claims.

What we claim is:

1. A skate board comprising: board means; two wheel mounts located on said board means; an axle carrier held by each of said wheel mounts; said axle carrier holding a roller axis elastically for two rollers; steering movements of said roller axes being produced by shifting a rider's weight; said board means having a longitudinal axis; transverse axle means located transverse to said longitudinal axis; at least one of said roller axes being pivotal about said transverse axle means; said board means being lowerable relative to said roller axis by applying the rider's weight; spring means; said board means being raisable relative to said roller axis by said spring means when the rider's weight is removed; said transverse axle being rigidly connected to said board means so that lowering and raising said board means do not produce steering movement of said roller axis; brake means on said board means and acting on said rollers when said board means is raised through absence of the rider's weight; said brake means being released when applying the rider's weight and lowering said board means.

2. A skate board as defined in claim 1, wherein said axle carrier with said roller axis are pivotable relative to said wheel mount about said transverse axle.

3. A skate board as defined in claim 1 wherein said wheel mount with said axle carrier and said roller axis are pivotable relative to said board means about said transverse axle.

4. A skate board as defined in claim 2, wherein said board means has a rubber-like elastic casing forming said wheel mounts.

5. A skate board as defined in claim 3, including a hinged edge wheel mount carrier having two legs, said wheel mounts being located on one of said legs, the other one of said legs being mounted on said board means; hinge pin means connecting said two legs and being formed by said transverse axle.

6. A skate board as defined in claim 5, wherein said brake means is placed into a brake position and/or released position by said one leg of said wheel mount carrier carrying said wheel mounts during pivotal movement of said carrier about said transverse axle.

7. A skate board as defined in claim 1 wherein said board means is lockable in lowered position relative to said roller axis, said brake means being released in said lowered position.

* * * * *